US007191480B2

(12) United States Patent
Romano et al.

(10) Patent No.: US 7,191,480 B2
(45) **Date of Patent: *Mar. 20, 2007**

(54) MATTRESS OR CUSHION STRUCTURE

(75) Inventors: James J. Romano, James Island, SC (US); Sohrab Soltani, Charleston, SC (US); Michael V. Bolden, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/793,723

(22) Filed: Mar. 5, 2004

(65) Prior Publication Data

US 2004/0168255 A1 Sep. 2, 2004

Related U.S. Application Data

(60) Continuation of application No. 09/921,317, filed on Aug. 2, 2001, now Pat. No. 6,701,556, which is a division of application No. 09/306,601, filed on May 6, 1999, now Pat. No. 6,269,504.

(60) Provisional application No. 60/084,411, filed on May 6, 1998.

(51) Int. Cl.

| | |
|---|---|
| ***A47C 27/00*** | (2006.01) |
| ***A47C 27/16*** | (2006.01) |
| ***A47C 27/18*** | (2006.01) |
| ***A47C 27/22*** | (2006.01) |
| ***A47C 27/08*** | (2006.01) |

(52) U.S. Cl. ..... 5/690; 5/706; 5/702; 5/726; 5/736; 5/665; 5/716; 5/709; 5/655.5; 5/952; 297/180.14

(58) Field of Classification Search ..... 5/706, 5/654, 710, 690, 644, 655.3, 952, 722, 726, 5/736, 665, 716, 709, 655.5; 297/180.14, 297/452.47, 452.46
See application file for complete search history.

(56) References Cited

U.S. PATENT DOCUMENTS

| | | | | |
|---|---|---|---|---|
| 274,495 | A * | 3/1883 | Heath | 5/706 |
| 325,227 | A * | 8/1885 | Young | 5/712 |
| 2,000,873 | A * | 5/1935 | Arens | 5/706 |
| 2,029,370 | A | 2/1936 | Heldenbrand | |
| 2,345,421 | A * | 3/1944 | Perry | 5/706 |
| 2,672,183 | A * | 3/1954 | Forsyth | 297/452.48 |
| 2,742,652 | A | 4/1956 | Mautz | |
| 3,000,020 | A | 9/1961 | Lombard et al. | |
| 3,030,145 | A | 4/1962 | Kottemann | |
| 3,047,888 | A | 8/1962 | Shecter et al. | |
| 3,080,578 | A | 3/1963 | Novascone | |

(Continued)

FOREIGN PATENT DOCUMENTS

| | | |
|---|---|---|
| BE | 885296 | 1/1981 |

(Continued)

*Primary Examiner*—Alexander Grosz
(74) *Attorney, Agent, or Firm*—Bose McKinney & Evans LLP

(57) ABSTRACT

An apparatus is configured to support at least a portion of a body thereon. The apparatus includes a base portion and a three dimensional engineered material, the three dimensional engineered material and the base cooperate to provide support for the body.

30 Claims, 10 Drawing Sheets

U.S. PATENT DOCUMENTS 3,109,182 A * 11/1963 Doak ..... 5/636
3,403,414 A * 10/1968 Unger ..... 5/636
3,421,163 A 1/1969 Stoughton
3,638,255 A * 2/1972 Sterrett ..... 5/641
3,644,950 A 2/1972 Lindsay, Jr.
3,757,366 A 9/1973 Sacher
3,778,851 A 12/1973 Howorth
3,939,508 A 2/1976 Hall et al.
3,974,532 A 8/1976 Ecchuya
4,163,297 A * 8/1979 Neumark ..... 5/702
4,207,636 A * 6/1980 Ceriani ..... 428/101
4,225,989 A 10/1980 Corbett et al.
4,267,611 A 5/1981 Agulnick
4,347,633 A 9/1982 Gammons et al.
4,391,009 A 7/1983 Schild et al.
4,449,261 A 5/1984 Magnusson
4,483,030 A 11/1984 Flick et al.
4,485,505 A 12/1984 Paul
4,486,909 A 12/1984 McKneelan
4,522,447 A 6/1985 Snyder et al.
4,580,301 A 4/1986 Ludman et al.
4,606,088 A * 8/1986 Michaelsen et al. ..... 5/636
4,631,221 A 12/1986 Disselbeck et al.
4,653,130 A 3/1987 Senoune et al.
4,706,313 A * 11/1987 Murphy ..... 5/722
4,753,480 A 6/1988 Morell
4,777,681 A 10/1988 Luck et al.
4,788,730 A 12/1988 Bexton
4,796,948 A 1/1989 Paul et al.
4,825,488 A 5/1989 Bedford
4,862,538 A 9/1989 Spann et al.
4,890,877 A 1/1990 Ashtiani-Zarandi et al.
4,930,173 A 6/1990 Woller
4,944,060 A 7/1990 Peery et al.
4,947,500 A 8/1990 Seiler
4,951,334 A 8/1990 Maier
4,970,743 A 11/1990 Wride et al.
5,002,336 A 3/1991 Feher
5,010,608 A 4/1991 Barnett et al.
5,039,567 A 8/1991 Landi et al.
5,085,487 A 2/1992 Weingartner et al.
5,088,747 A 2/1992 Morrison et al.
5,103,519 A 4/1992 Hasty
5,107,558 A 4/1992 Luck
5,111,544 A * 5/1992 Graebe ..... 5/654
5,191,664 A 3/1993 Wyatt
5,201,780 A 4/1993 Dinsmoor, III et al.
5,216,768 A 6/1993 Bodine et al.
5,231,717 A 8/1993 Scott et al.
5,243,722 A 9/1993 Gusakov
5,243,723 A 9/1993 Cotner et al.
5,255,404 A 10/1993 Dinsmoor, III et al.
5,259,079 A 11/1993 Visser et al.
5,269,030 A 12/1993 Pahno et al.
5,294,181 A 3/1994 Rose et al.
5,364,686 A 11/1994 Disselbeck et al.
5,370,439 A 12/1994 Lowe et al.
5,375,273 A 12/1994 Bodine, Jr. et al.
D355,488 S 2/1995 Hargest et al.
5,403,065 A 4/1995 Callerio
5,430,901 A 7/1995 Farley
5,442,823 A 8/1995 Siekman et al.
5,454,142 A 10/1995 Neely et al.
5,457,833 A 10/1995 Jay
5,487,196 A 1/1996 Wilkinson et al.
5,493,742 A 2/1996 Klearman
5,509,155 A 4/1996 Zigarac et al.
5,513,402 A 5/1996 Schwartz
5,513,899 A 5/1996 Michaels et al.
5,566,409 A 10/1996 Klearman
5,568,660 A 10/1996 Raburn et al.
5,592,707 A 1/1997 Dinsmoor, III et al.
5,617,595 A 4/1997 Landi et al.
5,636,395 A 6/1997 Serda
5,636,397 A * 6/1997 Boyd et al. ..... 5/739
5,638,564 A 6/1997 Greenawalt et al.
5,662,384 A 9/1997 O'Neill et al.
5,671,977 A 9/1997 Jay et al.
5,675,855 A 10/1997 Culp
5,678,265 A 10/1997 Meyer
5,678,891 A 10/1997 O'Neill et al.
5,680,662 A 10/1997 Purdy et al.
5,681,092 A 10/1997 Hanson et al.
5,687,436 A 11/1997 Denton
5,687,438 A 11/1997 Biggie et al.
5,689,845 A 11/1997 Sobieralski
5,731,062 A 3/1998 Kim et al.
5,755,000 A 5/1998 Thompson
5,797,155 A 8/1998 Maier et al.
5,802,646 A 9/1998 Stolpmann et al.
5,815,865 A 10/1998 Washburn et al.
5,855,415 A 1/1999 Lilley, Jr.
5,870,785 A 2/1999 Hoorens
5,887,304 A 3/1999 von der Heyde
5,926,884 A 7/1999 Biggie et al.
5,966,763 A * 10/1999 Thomas et al. ..... 5/715
5,987,668 A 11/1999 Ackley
6,014,783 A 1/2000 Collier et al.
6,052,851 A 4/2000 Kohnle
6,269,504 B1 8/2001 Romano et al.
6,286,167 B1 9/2001 Stolpmann
6,701,556 B2 3/2004 Romano et al.
6,782,574 B2 8/2004 Totton et al.

FOREIGN PATENT DOCUMENTS

CH 332754 11/1958
EP 0 464 692 1/1992
EP 0 606 892 7/1994
FR 2 656 795 7/1991
GB 2 181 048 4/1987
GB 2 225 229 5/1990
WO WO 98/36665 8/1998
WO WO 99/49761 10/1999

* cited by examiner

MATTRESS OR CUSHION STRUCTURE

CROSS-REFERENCE TO RELATED APPLICATION

This application is a continuation application of U.S. patent application Ser. No. 09/921,317, filed Aug. 2, 2001, now U.S. Pat. No. 6,701,556, the disclosure of which is incorporated herein by reference, which is a divisional application of U.S. patent application Ser. No. 09/306,601, filed May 6, 1999, now U.S. Pat. No. 6,269,504, the disclosure of which is incorporated herein by reference, which claimed the benefit of U.S. provisional application Ser. No. 60/084,411, filed May 6, 1998, the disclosure of which is also incorporated by reference.

BACKGROUND AND SUMMARY OF THE INVENTION

The present invention relates to mattress or cushion structures designed to improve pressure distribution while reducing the overall thickness of the mattress or cushion. The mattress or cushion structures of the present invention illustratively include a foam base on which one or more indented fiber layers or other three dimensional engineered material are placed. The base and the three dimensional engineered material layers are illustratively encased in a cover to provide a mattress or cushion.

While the use of foam in mattresses and cushions is known and the use of three dimensional engineered material is known, the present invention relates to a unique combination of a foam base and three dimensional engineered material layers placed on the foam base. The present invention also contemplates that, in addition to the foam base, an air cushion layer may be used with the foam and the indented fiber layers to further enhance the pressure distribution capabilities of the mattress or cushion. In some embodiments, the base may be primarily, if not solely, an air cushion which is enhanced by at least one three dimensional engineered material layer. In other embodiments, water filled bladders, springs, or zones filled with beads, gel or other such material may be used in the base.

Reference is made to U.S. Pat. Nos. 5,731,062 and 5,454,142 disclosing the three dimensional fiber networks made from textile fabrics that have projections and optional depressions which are compressible and return to their original shape after being depressed. U.S. Pat. Nos. 5,731,062 and 5,454,142 are owned by Hoechst Celanese Corporation, Somerville, N.J. Such material is a synthetic thermoplastic fiber network in flexible sheets having projections and/or indentations for use as cushions and/or impact-absorbing components. The descriptions of such patents are incorporated herein by reference to establish the nature of one example of three dimensional engineered material or indented fiber layer disclosed herein. It will be appreciated, however, that the present invention contemplates use of such layers whether or not they are supplied by Hoechst Celanese Corporation and whether or not they are similar to the SPACENET® product.

It is understood that other types of materials similar to the SPACENET® material may be used. For example, the material may be any type of three dimensional engineered material having a spring rate in both the X and Y axes. Preferably such material is open and breathable to provide air passage through the layer. For instance, Model No. 5875, 5886, 5898, and 5882 materials from Müller Textile, a molded thermoplastic spacer matrix material available from Akzo Nobel, or other suitable material may be used. Therefore, the term "three dimensional engineered material" is meant to include any of these types of materials used in accordance with the present invention.

The concept is to use three dimensional fiber layer networks made from textile fibers that have projections and optional depressions or other structures which are compressible and which return to their original shapes after being compressed or the equivalents of such layers. The SPACENET® fiber networks are typically made by thermomechanical deformation of textile fabrics that are in turn made from thermoplastic fibers. In accordance with the present invention other types of layers with individual spring or spring-like protrusions may be used.

It has been found that two or more such layers, hereinafter referred to as "indented fiber layers" for convenience will assist in the pressure distribution when incorporated into an assembly comprising a well designed support base which may comprise foam or some combination of foam and air. The SPACENET® layers are examples of such "indented fiber layers."

In the fabrication of a seat cushion, it has been found that improved pressure distribution is provided when the seat cushion is designed to form fit the buttocks of the person sitting on the cushion. When such seat cushions are used by patients who have experienced skin tissue breakdown on their buttocks, the improved pressure distribution will permit the patients to sit up in chairs for greater periods of time for the therapeutic value that accomplishes.

An apparatus of the present invention is therefore configured to support at least a portion of a body thereon. The apparatus includes a cover having an interior region, a base located within the interior region, and a three dimensional engineered material located within the interior region above the base. The three dimensional engineered material and the base cooperate to provide support for the body.

Additional features and advantages of the invention will become apparent to those skilled in the art upon consideration of the following detailed description of the illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
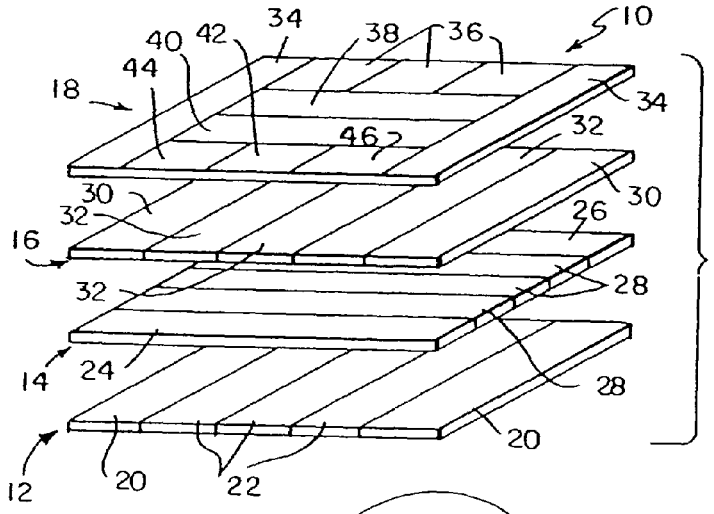
FIG. 1 is an exploded perspective view of a support surface base according to one embodiment of the present invention.

One embodiment of the present invention includes a base 10 upon which the three dimensional engineered material or the indented fiber layers are placed. The base 10 includes a plurality of layers of foam with each layer comprising a plurality of sections or strips of foam such as shown in FIG. 1. The FIG. 1 embodiment comprises four separate layers 12, 14, 16, 18 with each layer comprising a plurality of strips as illustrated. The strips are illustratively bonded together at their edges using conventional bonding techniques. The strips have various ILD ratings to provide desired support characteristics.

Lower layer 12, for instance, has its two outside strips 20 which are illustratively made from 150 ILD rating foam while the three central strips 22 are made from 60 ILD rating foam. The base 10 of FIG. 1 is a lattice structure in which the strips comprising the lower layer 12 are extending from front-to-back while the strips comprising the second layer 14 are extending transversely or side-to-side. The layer 14 comprises five transversely extending strips, the front and back strips 24, 26 being, for example, of 90 ILD rating foam. The three central strips 28 comprising the second layer 12 may be made from a foam having a softer or more deformable ILD rating. The third layer 16 is constructed such that each of its side strips 30 are made from 60 ILD rating foam while its three central strips 32 are made from 30 ILD rating foam as illustrated in FIG. 1.

The uppermost layer 18 has a pair of side strips 34 (extending front-to-back) made from 60 ILD foam. The upper layer 18 also has three transversely extending small pieces 36 at the back of the cushion with ILD ratings of 150, three centrally located sections 38, 40, 42 having a 30 ILD rating, and two side small sections 44, 46 have a 60 ILD rating. It will be appreciated that when these layers 12, 14, 16, 18 are superimposed together, the side edges (front-to-back) are provided largely by foam strips with higher ILD ratings including the first layer 12 side strips 20 with 150 ILD ratings and the third layer 16 with side strips 30 of 60 ILD ratings and the upper layer 18 with its side strips 34 with 60 ILD ratings. In the center of the composite cushion, in all four layers, the foam base 10 has lower ILD rating foam. At the back of the cushion, foam strips with higher ILD ratings including the 90 ILD rating strip 26 in the second layer 14 and the 150 ILD rating strips 36 in the upper layer 18 provide significant rigidity at the back.

With the composite structure shown in FIG. 1, the foam base conforms to the buttocks of the person sitting on the cushion. Alternatively, in accordance with the present invention, a cushion base 50 is formed by sculpting a single piece of foam 52 or a piece of foam made from various composite components bonded together to have the contour recessed portions 54 shown in FIG. 2 configured to match a person's anatomy.

Figure 2:
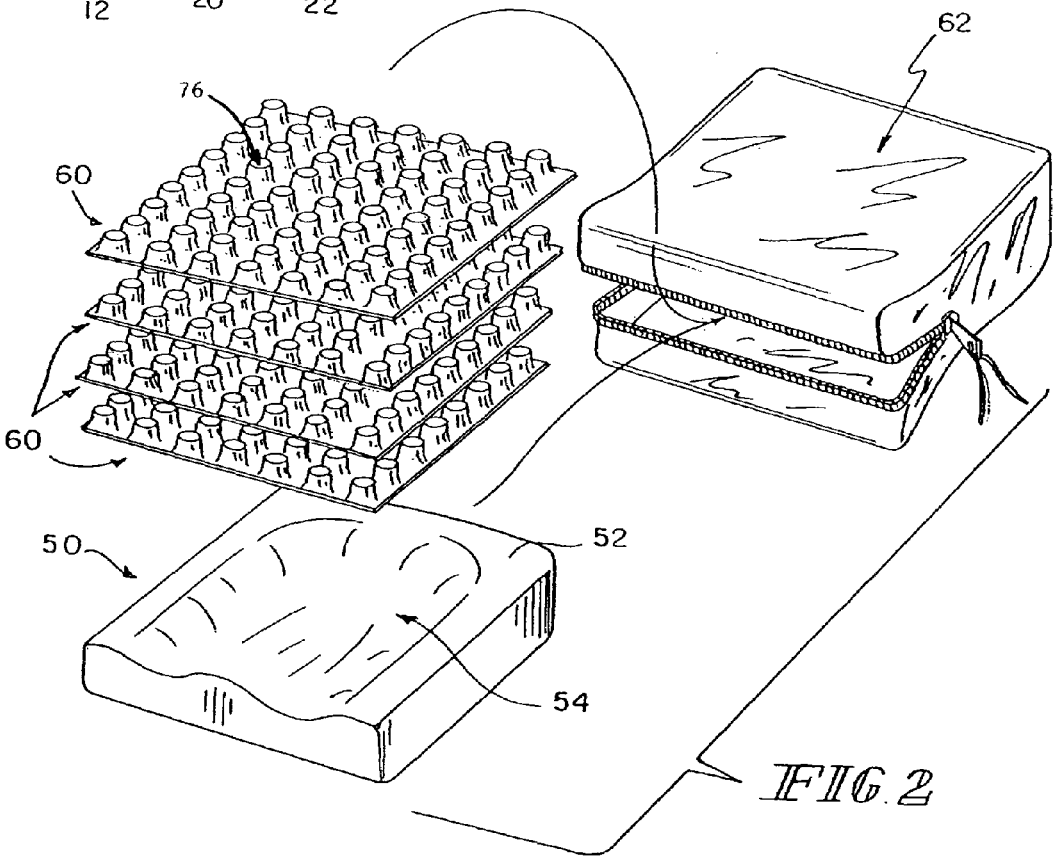
FIG. 2 is an exploded perspective view of another support surface of the present invention including a base, and a plurality of layers of three dimensional engineered material, and an outer cover.
Figure 2A:
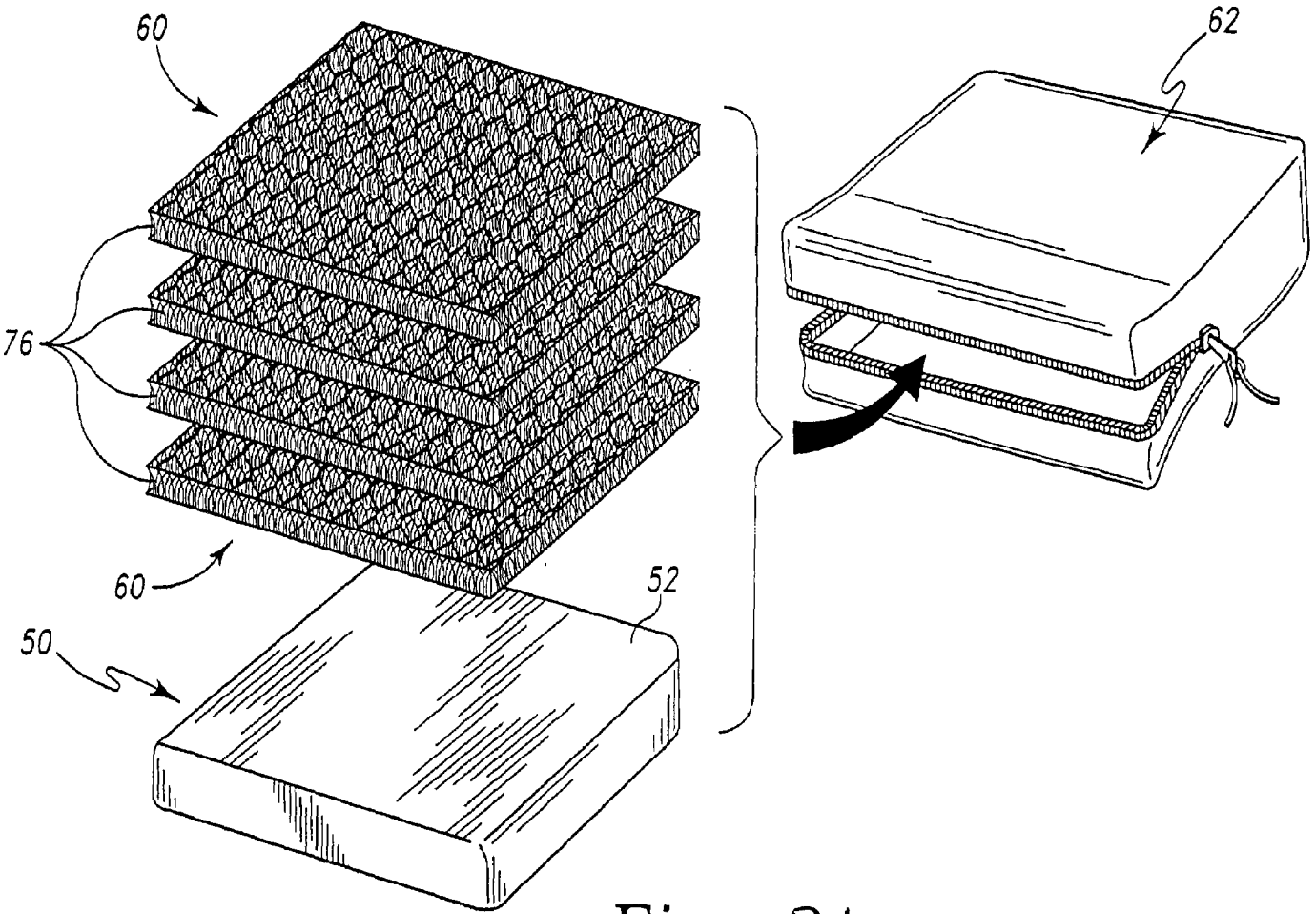
FIG. 2A is an exploded perspective view of another support surface of the present invention including a base, and a plurality of layers of three dimensional engineered material, and an outer cover.

The present invention includes placing above such a foam base 10, 50, one or more indented fiber layers or other such three dimensional engineered material layers having a plurality of resilient members 76 over the base 10, 50. Typically, two to four such layers 60 are provided as illustrated in FIG. 2 and FIG. 2A. The foam base 10, 50 and the plurality of layers 60 are then encased in a cover 62 as shown in FIG. 2. Details of the three dimensional engineered material layers are discussed above.

Figure 3:
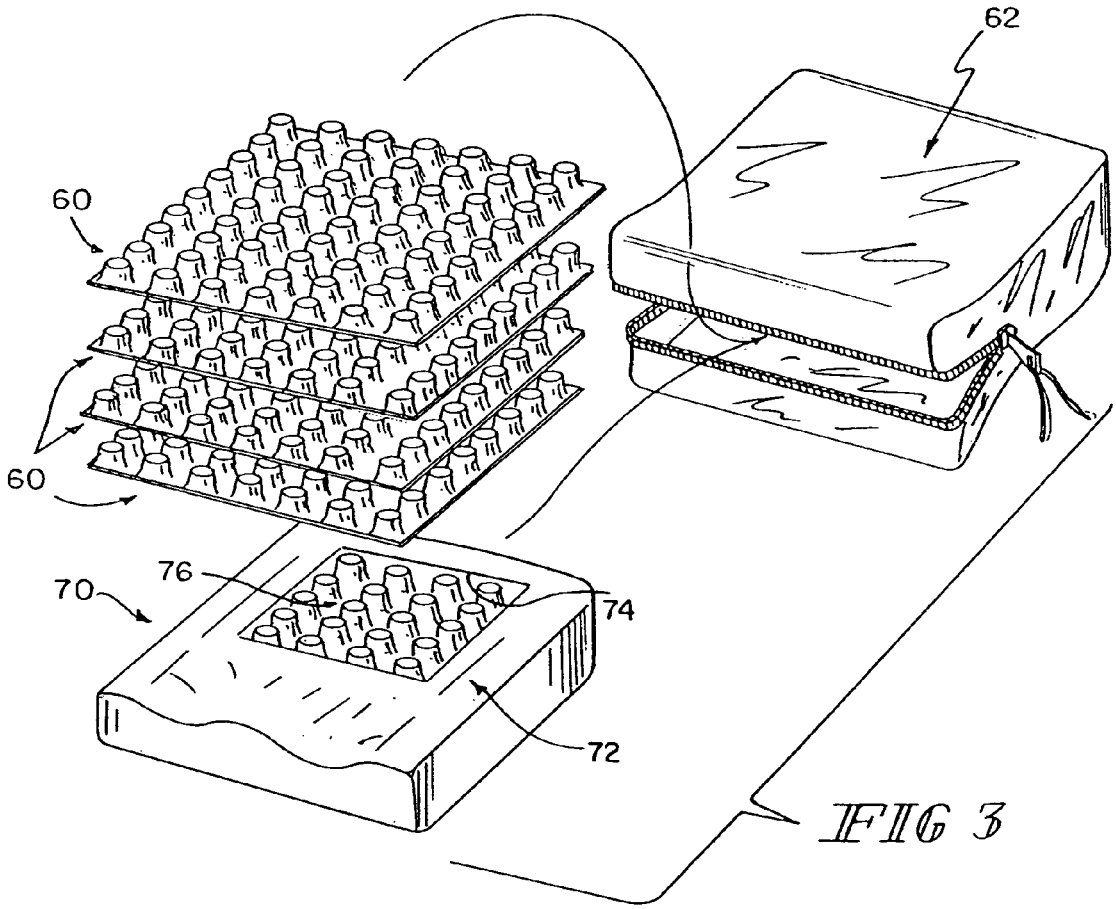
FIG. 3 is an exploded perspective view of another embodiment of the present invention similar to FIG. 2 in which the contoured base is also formed to include a recessed portion configured to receive at least one layer of three dimensional engineered material therein.
Figure 4:
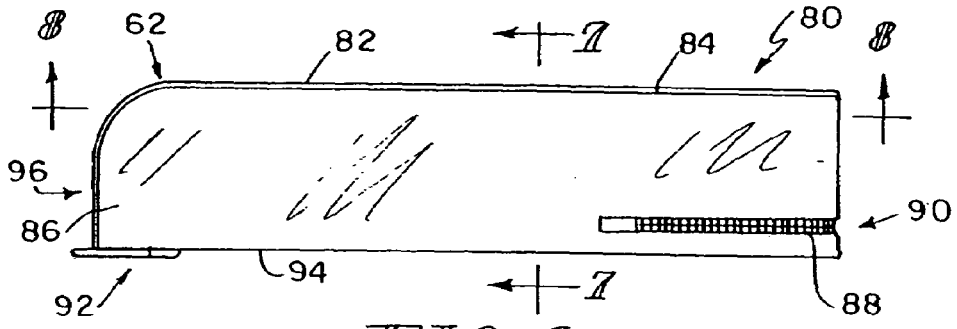
FIG. 4 is a side elevational view of another cushion structure of the present invention.
Figure 5:
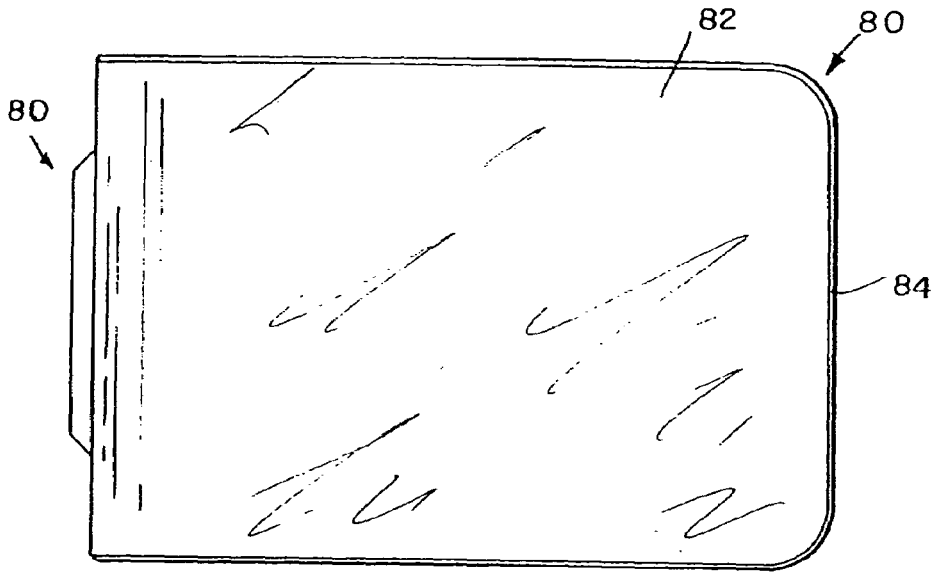
FIG. 5 is a top view of the cushion structure of FIG. 4.

In FIG. 3, a sculptured molded foam base 70 includes a contoured center portion 72 and is a cutout or recessed section 74 which is filled with at least one layer of three dimensional engineered material 76. A plurality of layers 60 similar to FIG. 2 are then placed over base 70. Base 70 and layers 60 are then located inside cover 62.

Figure 6:
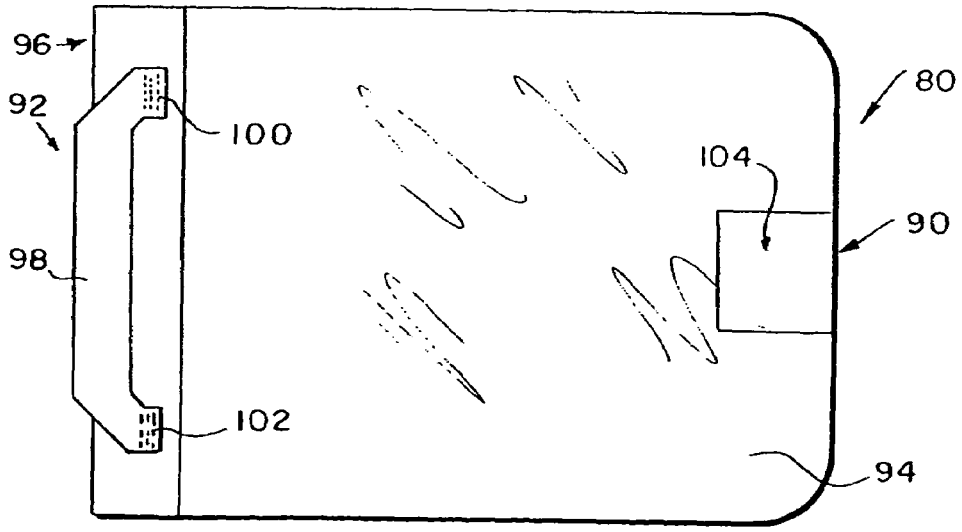
FIG. 6 is a bottom view of the cushion structure of FIGS. 4 and 5.
Figure 7A:
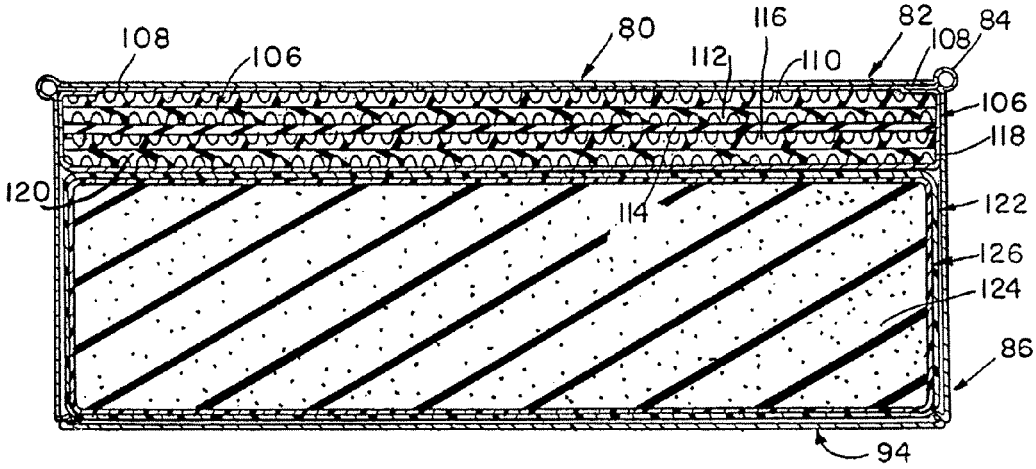
FIGS. 7A to 7G are sectional views taken along line 7—7 of FIG. 4.

Another embodiment of the present invention is illustrated in FIGS. 4–11. FIGS. 4–8 illustrate a cushion 80 having a top surface 82 and surrounding piping 84. Side walls 86 are illustratively made from heavy material which permits air to pass through. A zipper 88 is provided adjacent a rear portion 90 of the cushion 80 to provide access to an interior region. A handle 92 is coupled to a bottom surface 94 adjacent a front portion 96 of the cushion 80. FIG. 6 illustrates additional details of the handle 92. Handle 92 includes a central gripping portion 98 and ends 100 and 102 which are coupled to the bottom surface 94 by suitable means such as sewing, RF welding, or other suitable attachment. A label 104 is also located on the bottom surface 94.

Figure 8:
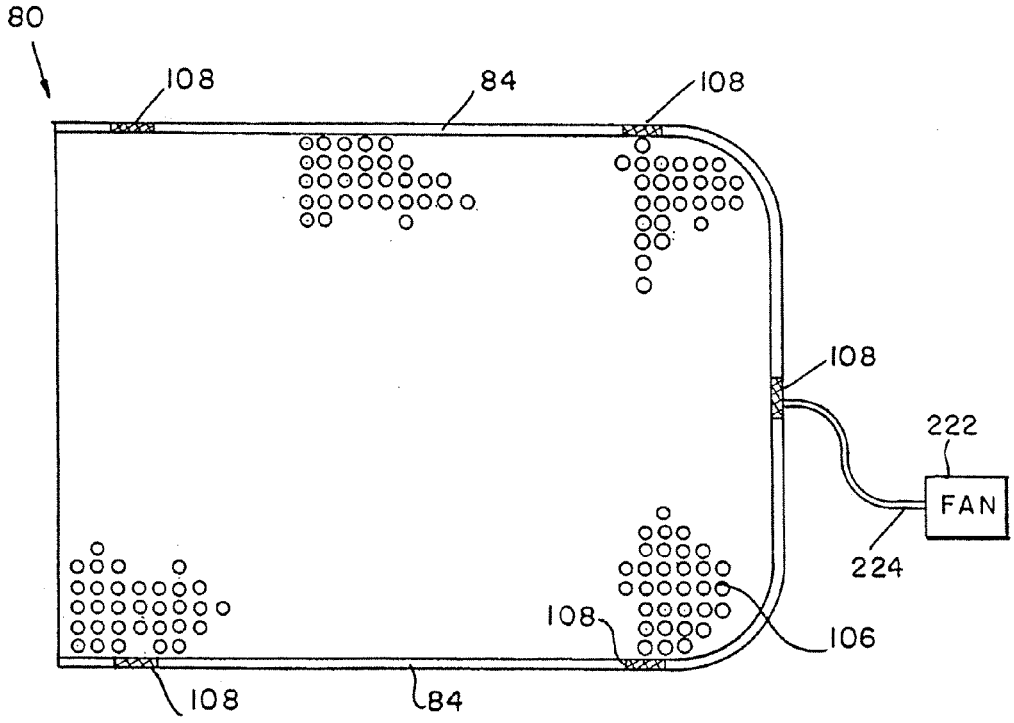
FIG. 8 is a sectional view taken along lines 8—8 of FIG. 4.

Further details of the cushion 80 are shown in FIGS. 7 and 8. Illustratively, the cushion includes a plurality of layers of three dimensional engineered material 106 located adjacent top surface 82. Top surface 82 is illustratively made from a breathable material such as Lycra. The three dimensional engineered material 106 is illustratively coupled to the outer piping 84 by suitable attachment such as stitching, welding, gluing, etc. at a plurality of locations as indicated by reference number 108 in FIGS. 7 and 8. Therefore, the engineered material layers 106 are permitted to float or move relative to the top surface 82 of the cushion 80. Illustrative examples of the different types of three dimensional engineered material 106 are discussed above.

In the illustrated embodiment, four layers of SPACENET® material are used including a top layer 110 with the indentions pointing upwardly, a second layer 112 with the indentions pointing downwardly, a central spacer layer 114 below layer 112, a layer 116 with the indentions pointing upwardly, and a layer 118 with the indentions pointing downwardly. Therefore, the layer of the three dimensional engineered material 106 is provided within the cover 62 of the cushion 80.

Cushion 80 further includes an inner plastic cover 122 surrounding a foam base 124. As discussed above, the foam base 124 can be a single piece of foam, a plurality of foam sections having different densities and ILDs stacked lengthwise or widthwise, or a plurality of layers of foam having different densities and ILDs.

Figure 7B:
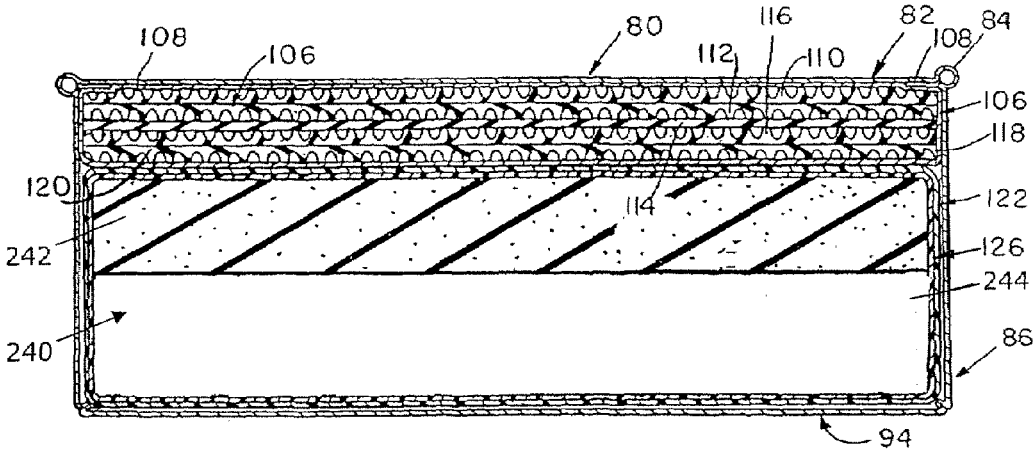
Figure 7C:
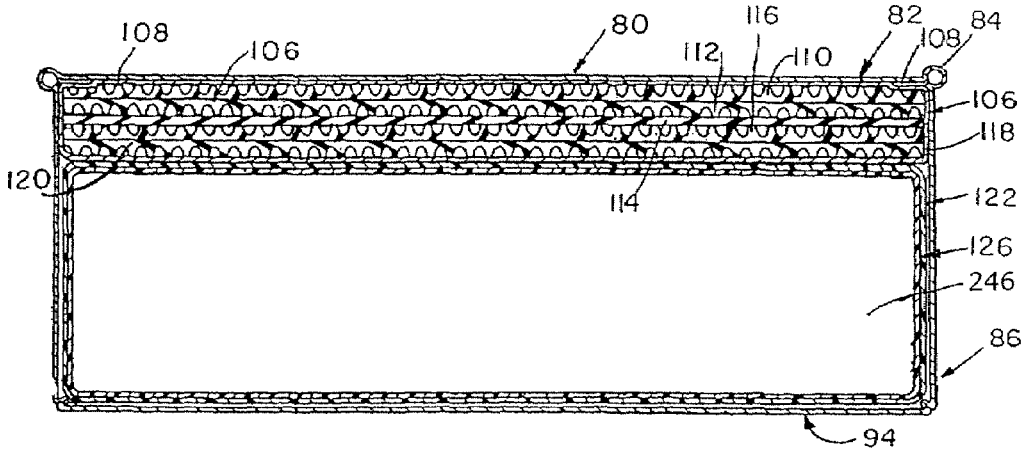
Figure 7D:
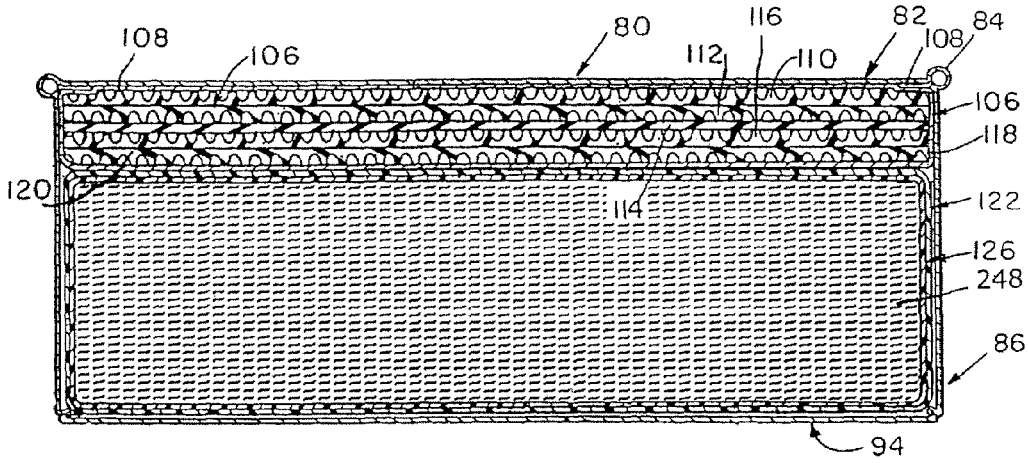
Figure 7E:
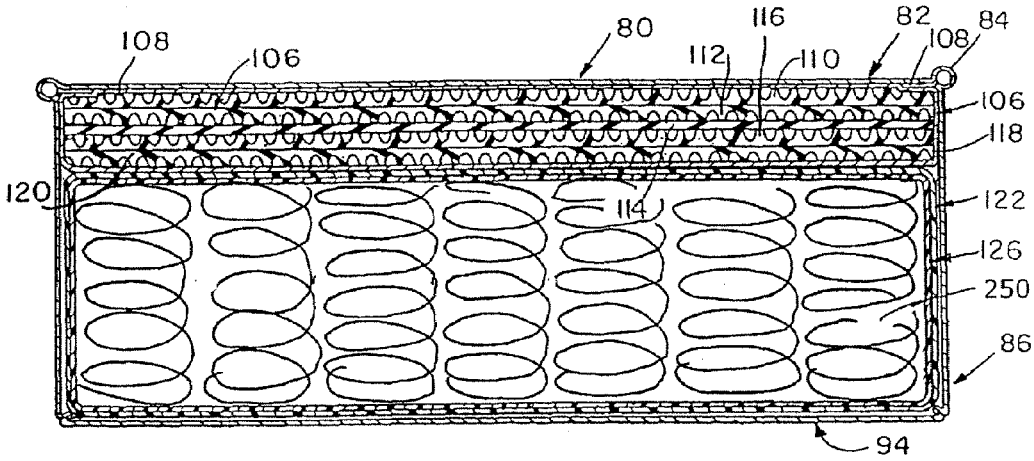
Figure 7F:
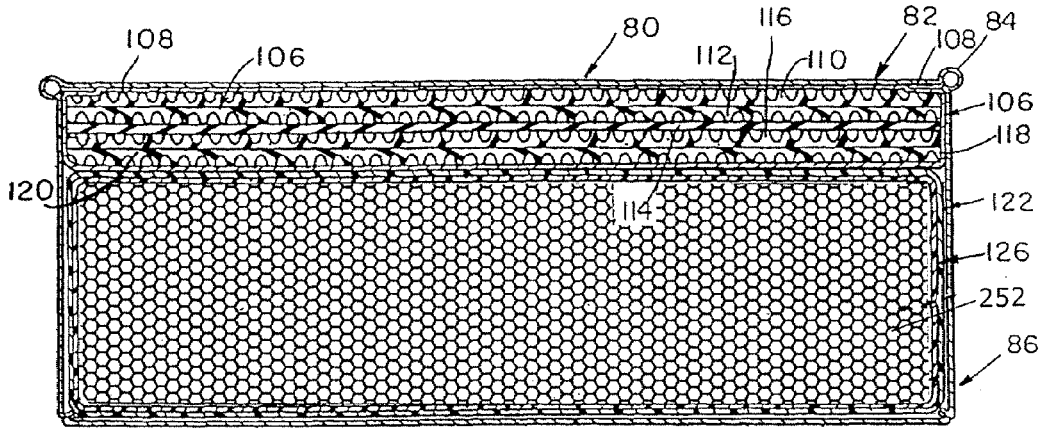
Figure 7G:
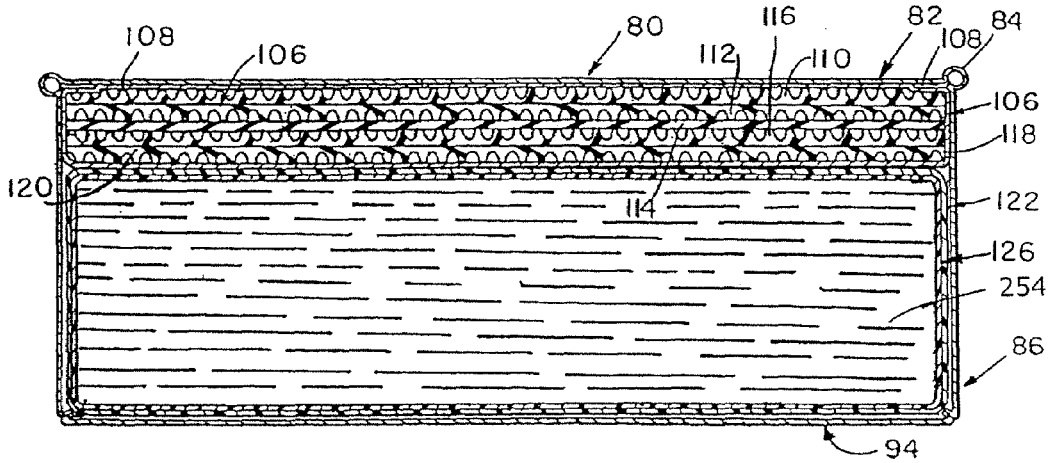

As further illustrated in FIG. 7B, a base 240 includes a foam base 242 and an air base 244. FIG. 7C illustrates a base 246 of air. FIG. 7D illustrates a base 248 of water. F*ig*. 7E illustrates a base 250 of springs. FIG. 7F illustrates a base 250 of beads. FIG. 7G illustrates a base 254 of gel.

A fire sock 126 is located between the plastic cover 122 and the foam base 124. Bottom surface 94 is illustratively made from an anti-skid material such as a dipped open weave nylon material.

Figure 9:
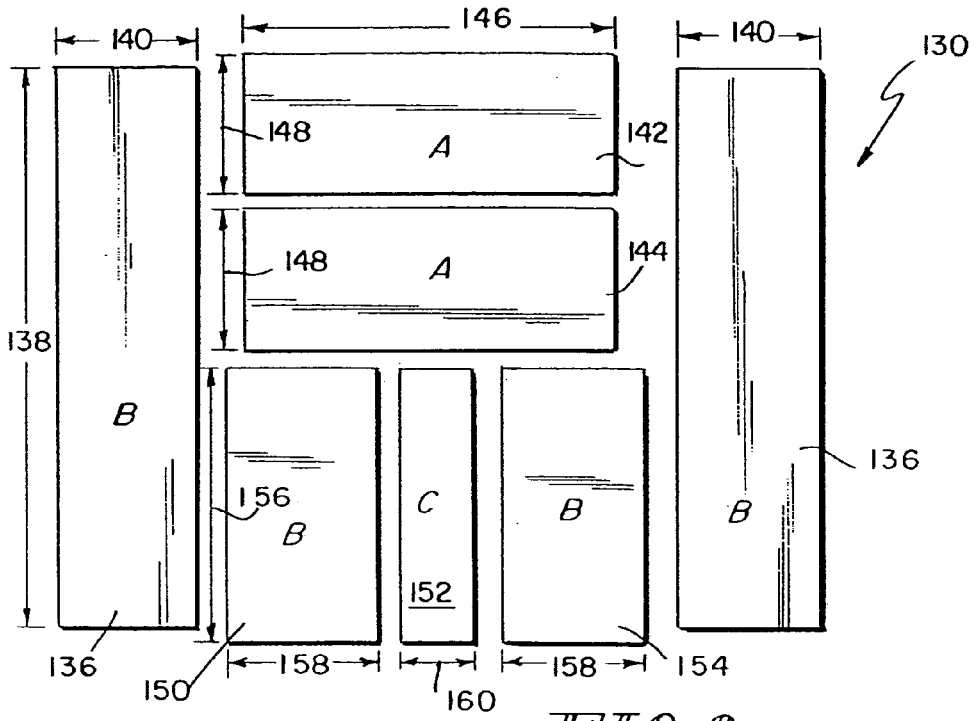
FIG. 9 is a view illustrating components of a top foam layer of a foam base configured to be inserted into an interior region of a cover shown in FIGS. 4–8.
Figure 10:
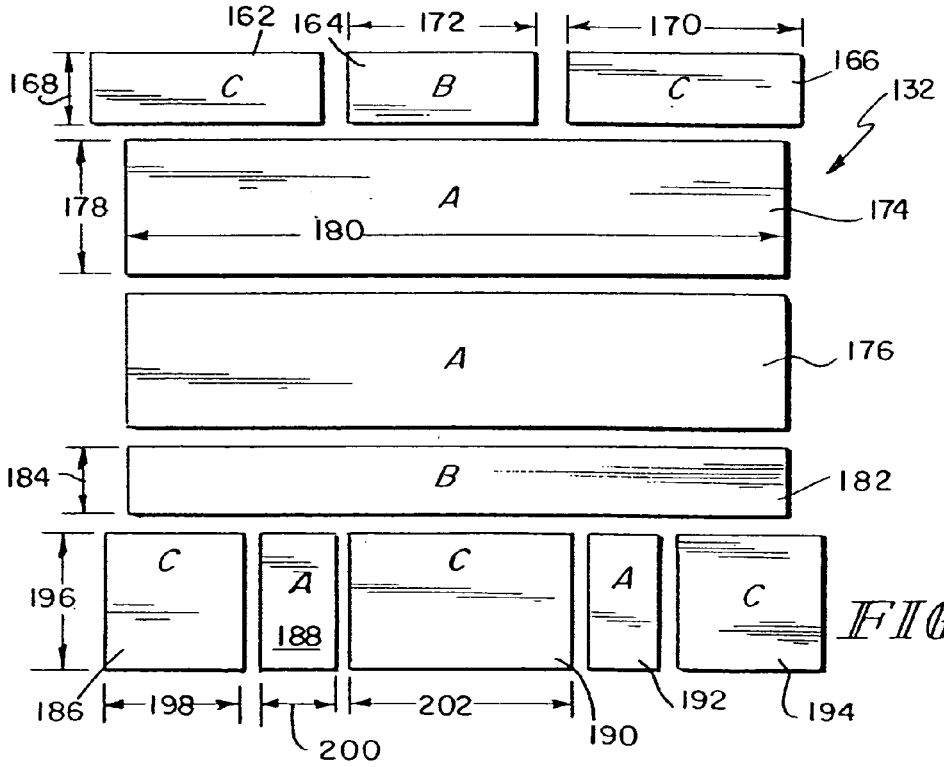
FIG. 10 is a view illustrating components of a middle foam layer of the base.
Figure 11:
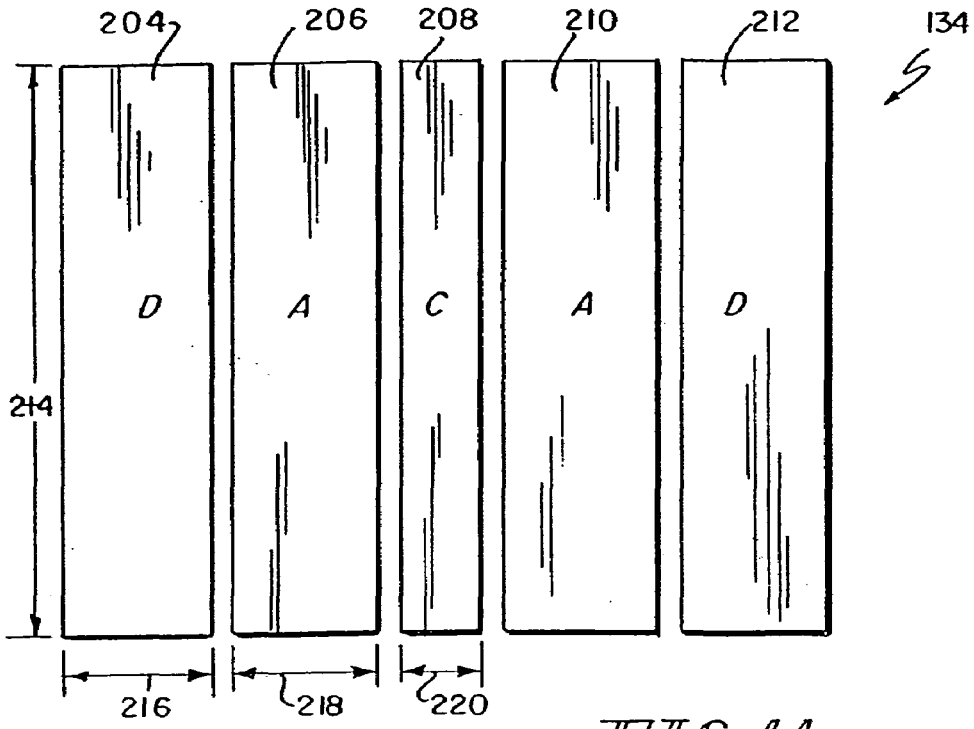
FIG. 11 is a view illustrating components of a bottom foam layer of the base.

Another embodiment of the foam base is illustrated in FIGS. 9–11. A top layer 130 of foam base 124 is illustrated in FIG. 9. A middle layer 132 of foam base 124 is illustrated in FIG. 10, and a bottom layer 134 of foam base 124 is illustrated in FIG. 11. It is understood that all the separate foam sections are glued together to form a substantially continuous layer of material for each of the three layers 130, 132, 134. Top layer 130 is glued to middle layer 132, and middle layer 132 is glued to the bottom layer 134.

Each of the foam sections is labeled with designations A, B, C, or D. These designations indicate the ranges of densities, and ILDs of the various foam sections to be discussed. The specifications for the foam sections are illustratively as follows:

| Foam Section | Density | ILD | Type |
|---|---|---|---|
| A | 1.7–1.8 | 40–47 | 1745 |
| B | 3.0 | 61–71 | Q61 |
| C | 1.7–1.8 | 90–100 | LH96X |
| D | 4.0–4.25 | 171–181 | Z171 |

Top foam layer 130 includes outer sections 136 illustratively having a length dimension 138 of 16 inches and width dimension 140 of 4 inches. Two sections 142 and 144 are located adjacent a back portion of top layer 130. In other words, section 142 is located adjacent back portion 90 within the cushion 80. Sections 142 and 144 each have a width dimension 146 of 10 inches and a length dimension 148 of 4 inches. Top layer 130 further includes front sections 150, 152 and 154. Sections 150 and 154 each have length dimensions 156 of 8 inches and width dimensions 158 of 4 inches. Central section 152 has a length dimension of 8 inches and a width dimension 160 of 2 inches. It is understood that dimensions used in FIGS. 9–10 are for illustrative purposes only. Sections having different widths and lengths may be used depending upon the size of the cushion and firmness characteristics desired.

Middle layer 132 is illustrated in FIG. 10. Middle layer 132 includes three back sections 162, 164, and 166. Outer back sections 162 and 166 each have a length dimension 168 of 2 inches and a width dimension 170 of 6.5 inches. Center back section 164 has a length of 2 inches and a width dimension 172 of 5 inches. Middle layer 132 further includes two low density, low ILD layers 174 and 176. Layers 174 and 176 each have a length dimension 178 of 4 inches and a width dimension 180 of 18 inches. A slightly higher ILD section 182 is located adjacent section 176. Section 182 has a width dimension of 18 inches and a length dimension 184 of 2 inches. Middle layer 132 further includes a plurality of front foam sections 186, 188, 190, 192, and 194. Outer sections 196 and 194 have a length dimension 196 of 4 inches and a width dimension 198 of 4 inches. Sections 188 and 192 each have a width dimension 200 of 2 inches and length dimension of 4 inches. Center section 190 has a length dimension of 4 inches and a width dimension 202 of 6 inches.

Bottom layer 134 is illustrated in FIG. 11. Illustratively, bottom layer 134 includes five sections 204, 206, 208, 210, and 212 extending front to back. Outer sections 204 and 212 have a high density and high ILD. Outer sections 204 and 212 each have a length dimension 214 of 16 inches and width dimension 216 of 4 inches. Sections 206 and 210 are located inwardly of outer sections 204 and 212, respectively. Sections 206 and 210 each have a low density and low ILD. Sections 206 and 210 have a length dimension of 16 inches and a width dimension 218 of 4 inches. Center portion 208 has a relatively high ILD. Central section 208 has a length dimension of 16 inches and a width dimension 220 of 2 inches. After the top layer 130, the middle layer 132, and the bottom layer 134 are all coupled together to form a base 124, the base 124 is inserted into the cover 62 as illustrated above to form an improved seating cushion 80.

In another embodiment of the present invention, a fan 222 is coupled to the cushion 80. Illustratively, fan 222 is coupled to the cushion 80 by a tube 224 as shown in FIG. 8. Fan 222 may be packaged to sit on the floor or may include a bracket for coupling the fan 222 to a wheelchair, chair, bed, etc. The fan 222 forces air through the three dimensional engineered material 106 and top surface 82 to provide cooling for a person situated on the cushion 80.

Figure 12:
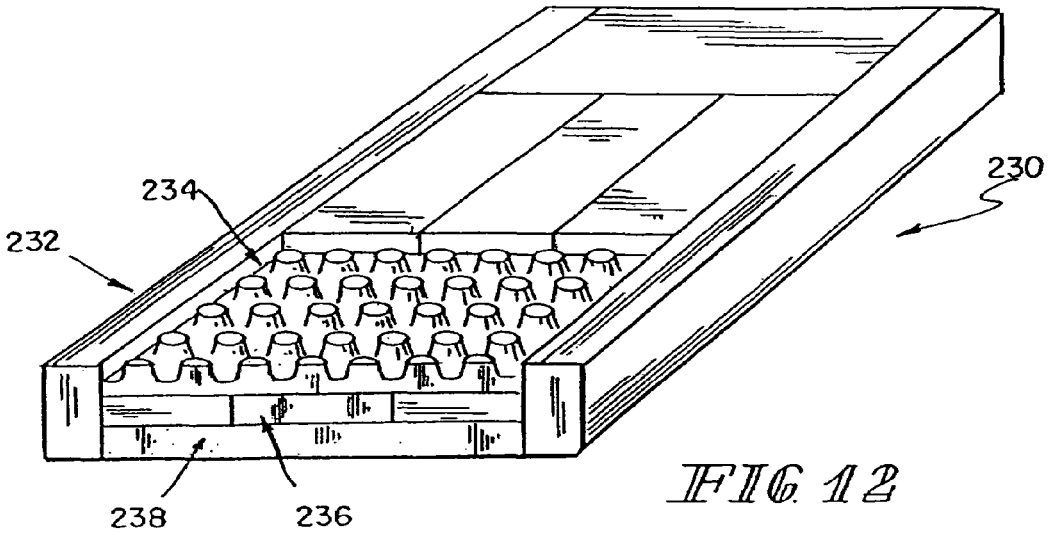
FIG. 12 is a perspective view a mattress in accordance with the present invention.

As illustrated in FIG. 12, the apparatus of the present invention may also be used in a mattress or other support surface 230. The zones of the mattress 230 are illustratively made from foam sections having different densities and ILD ratings. In addition, the mattress 230 includes a foot end 232 having three dimensional engineered material 234 located therein above foam layers 236 and 238. The fan 222 may also be coupled to the support structure illustrated in FIG. 12 to provide air flow and cooling through zone 232.

Although the invention has been described in detail with reference to certain illustrated embodiments, variations and modifications exist within the scope and spirit of the present invention as described and defined in the following claims.

What is claimed is:

1. A mattress apparatus for supporting at least a portion of a body thereon, the apparatus comprising:

a base portion;

a first layer including a synthetic fiber network supported by the base portion, wherein the synthetic fiber network of the first layer includes one of upwardly pointing projections and downwardly pointing projections; and a second layer including a synthetic fiber network supported by the base portion, wherein the synthetic fiber network of the second layer includes one of upwardly pointing projections and downwardly pointing projections, the one synthetic fiber network of the second layer being oriented differently than the one synthetic fiber network of the first layer.

2. The mattress apparatus of claim 1, further comprising a fire sock and a plastic layer surrounding the base portion.

3. The mattress apparatus of claim 1, wherein the synthetic fiber network is a breathable synthetic fiber network.

4. The mattress apparatus of claim 1, wherein the synthetic fiber network is a synthetic thermoplastic fiber network.

5. The mattress apparatus of claim 1, wherein the first layer and the second layer are separated by a spacer layer.

6. The mattress apparatus of claim 1, wherein the base portion includes a top surface and the synthetic fiber network of the first layer substantially overlays the top surface of the base portion.

7. The mattress apparatus of claim 1, wherein the base portion includes a top surface and the synthetic fiber network of the first layer and the synthetic fiber network of the second layer substantially overlay the top surface of the base portion.

8. The mattress apparatus of claim 1, wherein the base portion includes a plurality of zones, each zone having associated support characteristics, the support characteristics of a first zone differing from the support characteristics of a second zone.

9. The mattress apparatus of claim 8, wherein the first zone corresponds to a foot end of the base portion.

10. The mattress apparatus of claim 9, wherein each of the plurality of zones of the base portion includes at least one foam member.

11. The mattress apparatus of claim 8, further comprising a cover having an interior region, the base portion and the at least one layer including the synthetic fiber network being located within the interior region.

12. The mattress apparatus of claim 11, wherein the synthetic fiber network of the first layer is coupled to the cover at a plurality of separate spaced apart locations.

13. The mattress apparatus of claim 11, wherein the cover includes an air permeable surface, the synthetic fiber network of the first layer being located adjacent the air permeable surface.

14. The mattress apparatus of claim 13, wherein the air permeable surface is at least a portion of a top surface of the cover, the portion of the top surface and the synthetic fiber network of the first layer cooperating to provide cooling for the body supported on the portion of the top surface.

15. The mattress apparatus of claim 14, further comprising a source of air coupled to the cover to provide air circulation through the synthetic fiber network of the first layer.

16. The mattress apparatus of claims 15, wherein the air from the source of air is further forced through the portion of the top surface.

17. The mattress apparatus of claims 15, wherein the source of air is a fan.

18. The mattress apparatus of claim 15, wherein the cover further comprises at least one side wall, the side wall being configured to permit air to pass through.

19. The mattress apparatus of claim 14, wherein air circulation is further provided through the air permeable surface of the cover.

20. The mattress apparatus of claim 11, further comprising a handle coupled to the cover.

21. The mattress apparatus of claim 11, wherein the cover includes a bottom surface formed from an anti-skid material.

22. The mattress apparatus of claim 11, wherein the cover further includes a zipper configured to provide access to the interior region of the cover.

23. The mattress apparatus of claim 8, wherein the synthetic fiber network of the first layer is supported by the first zone of the base portion.

24. The mattress apparatus of claim 1, wherein the base portion includes at least one foam member.

25. The mattress apparatus of claim 24, wherein the base portion further includes an air cushion, the foam member and the air cushion cooperating with the synthetic fiber network of the first layer to provide support for the portion of the body supported by the mattress apparatus.

26. The mattress apparatus of claim 1, wherein the base portion includes an air cushion.

27. The mattress apparatus of claim 1, wherein the base portion includes at least one of water filled bladders, springs, zones filled with beads, and zones filled with gel.

28. The mattress apparatus of claim 1, wherein the synthetic fiber network of the first layer includes upwardly pointing projections, and the synthetic fiber network of the second layer includes downwardly pointing projections, the first layer being supported by the second layer.

29. The mattress apparatus of claim 1, wherein the synthetic fiber network of the first layer includes downwardly pointing projections and the synthetic fiber network of the second layer includes upwardly pointing projections, the first layer being supported by the second layer.

30. The mattress apparatus of claim 1, further comprising a third layer including a synthetic fiber network and a fourth layer including a synthetic fiber network, wherein the synthetic fiber network of the third layer includes upwardly pointing projections and the synthetic fiber network of the fourth layer includes downwardly pointing projections, the third layer being supported by the fourth layer and the first layer and the second layer being supported by the third layer.

* * * * *